United States Patent [19]

Glösmann

[11] 4,198,258

[45] Apr. 15, 1980

[54] APPARATUS FOR APPLYING ADHESIVE-COATED LABELS TO CIGARETTE PACKS OR THE LIKE

[75] Inventor: Josef Glösmann, Hamburg, Fed. Rep. of Germany

[73] Assignee: Hauni-Werke Körber & Co. KG., Hamburg, Fed. Rep. of Germany

[21] Appl. No.: 961,196

[22] Filed: Nov. 16, 1978

[30] Foreign Application Priority Data

Nov. 26, 1977 [DE] Fed. Rep. of Germany ..... 2752819

[51] Int. Cl.[2] ..... B65B 61/00

[52] U.S. Cl. ..... 156/484; 53/137; 53/466; 53/586; 156/568; 156/571

[58] Field of Search ..... 53/397, 466, 137, 586, 53/230, 231, 234; 156/458, 568, 571, 475, 483, 484–485

[56] References Cited

U.S. PATENT DOCUMENTS

| | | | |
|---|---|---|---|
| 1,543,722 | 6/1925 | Bronander | 156/485 X |
| 3,075,325 | 1/1963 | Liedtke | 53/466 |
| 3,200,555 | 8/1965 | Liedtke | 53/466 X |
| 3,527,014 | 9/1970 | Wahle et al. | 53/466 X |
| 3,543,471 | 12/1970 | Youngman | 53/466 |

*Primary Examiner*—David A. Simmons
*Attorney, Agent, or Firm*—Peter K. Kontler

[57] ABSTRACT

Apparatus is provided for the application of elongated labels to front end faces and adjacent lateral surfaces of cigarette packs which are transported at intervals through an elongated folding duct. The duct is mounted in a rotary barrel having openings for label carriers which accept labels during travel past a magazine and thereupon place the labels across the inlet of the duct prior to being moved out of the way so that the front end face of an oncoming pack adheres to the central portion of a label which extends across the inlet and the pack pushes such label against the rear end face of the preceding pack while the duct automatically folds the end portions of the label over the adjacent lateral surfaces of the respective pack. Patches of adhesive are applied to successive labels during travel with the corresponding carriers from the magazine toward the inlet of the folding duct.

16 Claims, 3 Drawing Figures

APPARATUS FOR APPLYING ADHESIVE-COATED LABELS TO CIGARETTE PACKS OR THE LIKE

BACKGROUND OF THE INVENTION

The present invention relates to apparatus for applying labels to successive commodities, especially to substantially brick-shaped prismatic commodities or items, such as packs for cigarettes, cigars or cigarillos. More particularly, the invention relates to improvements in apparatus for applying adhesive labels or analogous pieces of flexible sheet material to selected portions of substantially prismatic items while the items move, either continuously or stepwise. Typical examples of labels which can be applied in the apparatus of the present invention are revenue labels which are glued across the front or top end faces of soft packs or hard packs (including hinged-lid or flip-top packs) for plain or filter tipped smokers' products.

Label applying apparatus normally form integral parts of packing machines for rod-shaped smokers' products (hereinafter called cigarettes for short). It is also known to install label applying apparatus between a packing machine and a machine which provides cigarette packs or the like with transparent or translucent outer envelopes consisting of cellophane or other plastic material. In many instances, such transparent outer envelopes embody customary tear strips to allow for rapid removal of outer envelopes and afford access to the one or the other end of the pack. In the case of flip-top packs, revenue labels are applied in such a way that a properly applied label must be destroyed before the user can pivot the hinged lid of the pack to open position.

The labels are relatively small, long and narrow, and they are applied to the packs in such a way that the central portion of a properly applied label overlies and adheres to the front end face of the pack while the end portions of the label overlie and are bonded to the adjacent (narrower or wider) lateral surfaces of the respective pack. In heretofore known label applying apparatus, the central portion of a label is attached to the front end face of an oncoming pack in a first step, and the end portions of the label are thereupon folded over the adjacent lateral surfaces of the pack by discrete folding instrumentalities. When the pack is a so-called soft pack, the label normally extends across the width of the front end face of the pack and its end portions are bonded to the adjacent wide lateral surfaces, normally at an angle of 90 degrees to the central portion of the label. When the packs are flip-top packs, the label is applied lengthwise of the top face of the lid and its end portions overlie and adhere to the narrow lateral surfaces of the pack.

The fact that the labels (especially revenue labels) are elongated contributes to complexity of the apparatus. Conventional apparatus include several conveyors one of which receives labels from a magazine or an analogous source of stacked labels and another of which places the central portions of successive labels into the path of oncoming packs. The end portions of the label are thereupon flexed to contact and adhere to the corresponding lateral surfaces. Such apparatus operate properly as long as the speed of the machine which supplies packs is below a certain limit. However, the speed of modern packing machines is so high that conventional label applicators cannot furnish and attach labels with the required degree of accuracy. Furthermore, many presently known high-speed packing machines for cigarettes or the like are about to be replaced with machines whose output is still higher. Consequently, there exists an urgent need for apparatus which can apply labels with a requisite degree of accuracy even if the speed at which the items must be labelled is a multiple of the speed which is required to apply labels to cigarette packs at the rate they issue from the majority of presently used packing machines. In the absence of a labelling apparatus which operates satisfactorily while a machine turns out say 400 packs per minute, the output of the packing machine must be reduced on the sole ground that the labelling apparatus is incapable of applying labels at the required rate.

OBJECTS AND SUMMARY OF THE INVENTION

An object of the invention is to provide an apparatus for the application of adhesive labels or like flexible articles of paper or similar material to substantially prismatic items, especially to packs containing smokers' products, in such a way that each and every label is applied in the desired manner even if the application of labels takes place at a high speed as required when the apparatus is located at the discharge end of a mass-producing packing machine for plain or filter tipped cigarettes, cigars or cigarillos.

Another object of the invention is to provide an apparatus which can be readily adjusted to enable it to apply smaller or larger, narrower or wider labels to relatively small, medium-sized or large items.

A further object of the invention is to provide an apparatus which treats the labels gently and wherein the labels need not be repeatedly transferred during transport from a source to the locus of application to the respective items.

An additional object of the invention is to provide an apparatus wherein the labels are manipulated by a small number of parts and wherein the folding of end portions of labels over the lateral surfaces of the items takes place automatically as a result of transport of the items on their way to a further processing station.

Another object of the invention is to provide an apparatus wherein the items which are to be labelled or which are already provided with labels assist in the application of labels to successive items.

An additional object of the invention is to provide an apparatus wherein the labels are less likely to be applied in improper orientation and/or to be deformed during application to block-shaped items than in heretofore known apparatus.

Another object of the invention is to provide an apparatus which can apply labels to cigarette packs or the like in such a way that each and every part of an applied label is free of folds or other irregularities.

The invention is embodied in an apparatus for applying adhesive labels having a predetermined length to the front end faces and adjacent lateral surfaces of substantially prismatic items, especially packs for plain or filter tipped cigarettes or the like wherein the width of the front end faces between the lateral surfaces is less than the length of the labels. The apparatus comprises means for transporting a series of discrete items along a first path having a discharge end (such discharge end may be disposed at a level above the level of the preceding portion or portions of the first path), a magazine or another suitable source of labels, and means for transferring labels from the source. The transferring means includes a hollow rotary member (e.g., a drum which rotates about a horizontal axis and has a cylindrical barrel) and a plurality of label carriers which are mounted in and are rotatable with the rotary member along an endless second path extending along the source (where the carriers receive labels) and the discharge end of the first path (where the carriers are disengaged from labels). Each carrier is movable relative to the rotary member between first and second positions (preferably in the circumferential direction of the rotary member) in which the carrier is respectively ready to accept a label from the source and is remote from the label.

The apparatus further comprises a folding device which is installed in the interior of the rotary member and defines a passage for successive items of the aforementioned series. The passage has an inlet which is adjacent to the discharge end of the first path and is located inwardly of the second path (i.e., a portion of the second path is disposed between the inlet of the passage and the discharge end of the first path), and an outlet. The carriers have suction ports or other suitable means for retaining labels during transfer of labels from the source to the aforementioned portion of the second path in front of the inlet, and the transferring means further comprises means (preferably a rotary cam which is tracked by followers connected with the carriers) for moving the carriers to the first positions ahead of the source (so that each carrier is ready to accept a label during movement past or during a period of dwell at the source) and to the second positions not later than in the aforementioned portion of the second path so that each carrier moves away from the respective label (as mentioned above, the carriers can move in the circumferential direction of the rotary member) while the label extends transversely of and its end portions project beyond the inlet of the passage which is defined by the folding device. The apparatus further comprises a reciprocable pusher or analogous means for advancing successive items of the series from the discharge end of the first path into and through the passage of the folding device whereby the front end face of such oncoming item entrains and is bonded to the central portion of the adhesive-coated side of the label which extends across the inlet and pushes the uncoated side of such label against the preceding item while the folding device folds the end portions of the label over the adjacent lateral surfaces of the respective oncoming item. The folding device preferably resembles a duct and the cross-sectional area of its passage preferably matches the cross-sectional areas of the items so that two walls of the duct automatically fold the end portions of a label which is pushed into the passage and cause the thus folded end portions to adhere to the corresponding lateral surfaces of the item whose front end face is connected with the central portion of the label.

The folding device is preferably reciprocable in the interior of the rotary member, or the rotary member contains means (such as a rack-and-pinion drive) which can move the folding device in and counter to the direction of movement of the pusher. This renders it possible to convert the appartus for the application of labels to shorter or longer items.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
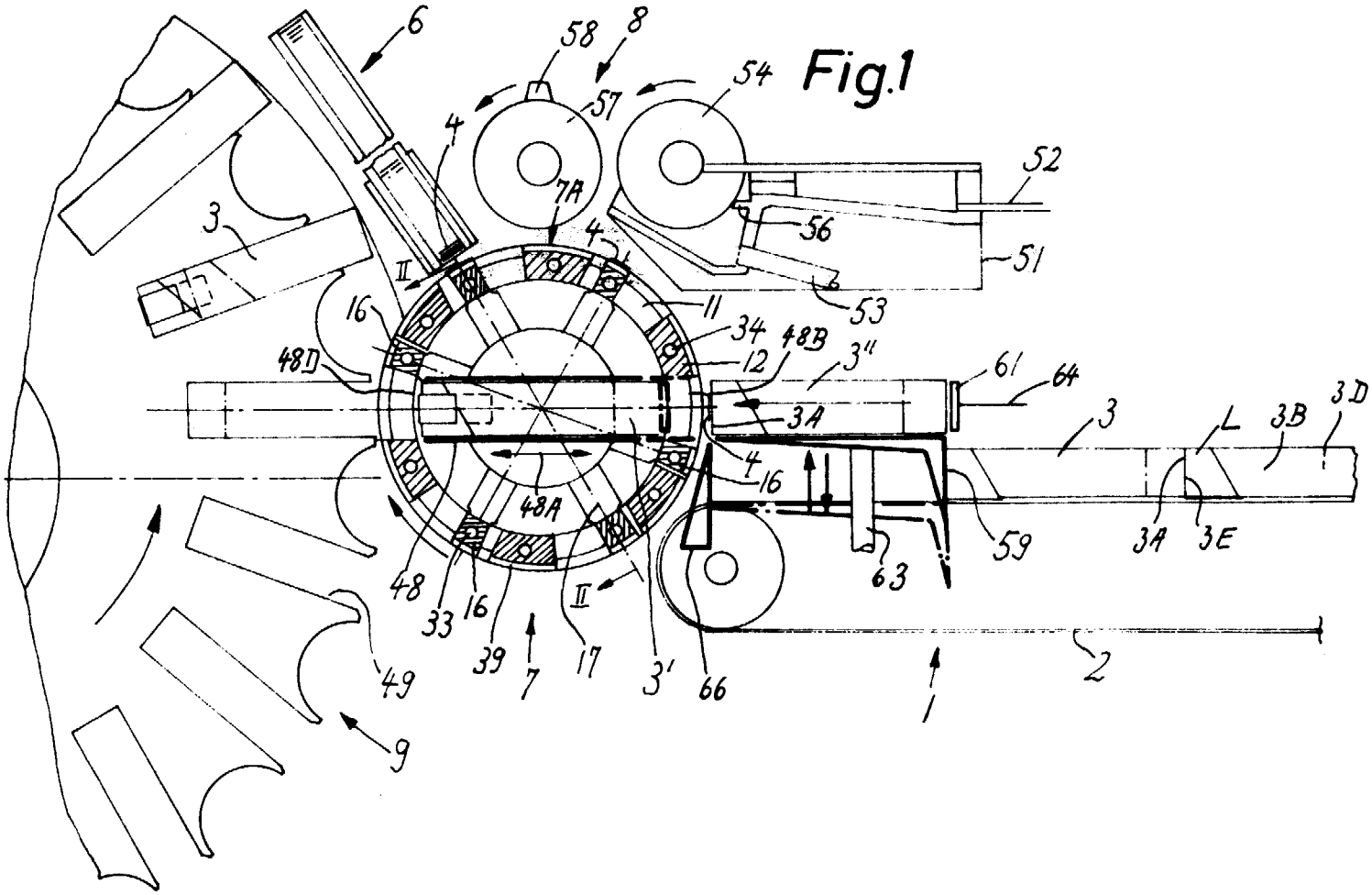
FIG. 1 is a schematic side elevational view of the improved labelling apparatus, with the rotary member and the label carriers of the transferring means shown in section.

Referring first to FIG. 1, where is shown an apparatus which is incorporated into or combined with a packing machine for cigarettes or other rod-shaped articles which constitute smokers' products. The apparatus is utilized to apply labels 4 to the front end face 3A and the adjacent lateral surfaces 3B, 3D of successive packs 3 which are supplied by a transporting system 1 including an endless belt or chain conveyor 2. The illustrated packs 3 are so-called hinge-lid packs; however, the apparatus can be used with equal advantage for the application of labels to so-called soft packs or any other substantially prismatic items wherein the width or length of the front end face 3A (as measured between the lateral surfaces 3B and 3D or the other two lateral surfaces) is less than the corresponding dimension (length) of a label 4. Each label 4 may constitute a revenue label or simply a piece of adhesive-coated flexible material which is applied to packs in order to close their front ends or for decorative purposes. It is assumed that the labels 4 are revenue labels which must be applied in such a way that the lid L of a pack 3 cannot be opened without destroying a properly applied label.

The conveyor 2 is driven at a constant speed by the main prime mover of a packing machine, not shown, e.g., a machine of the type disclosed in commonly owned U.S. Pat. No. 4,004,395 granted Jan. 25, 1977 to Bardenhagen et al. The labels 4 are stored in a magazine 6 and are delivered into the path of oncoming packs 3 by a transfer unit including a rotary drum-shaped member 7 (hereinafter called drum for short). Each label 4 which is withdrawn from the magazine 6 is coated with adhesive by a paster 8, and the packs 3 which carry properly applied labels 4 are introduced into the pockets 49 of a rotary turret-shaped drying conveyor 9 of the type disclosed in the aforementioned U.S. Pat. No. 4,004,395. The means (not shown) for withdrawing successive lowermost labels 4 from the magazine 6 and for delivering the withdrawn labels to the drum 7 may be of the type disclosed in commonly owned allowed copending application Ser. No. 636,580 filed Dec. 1, 1975 by Bernhard Schubert.

Figure 2:
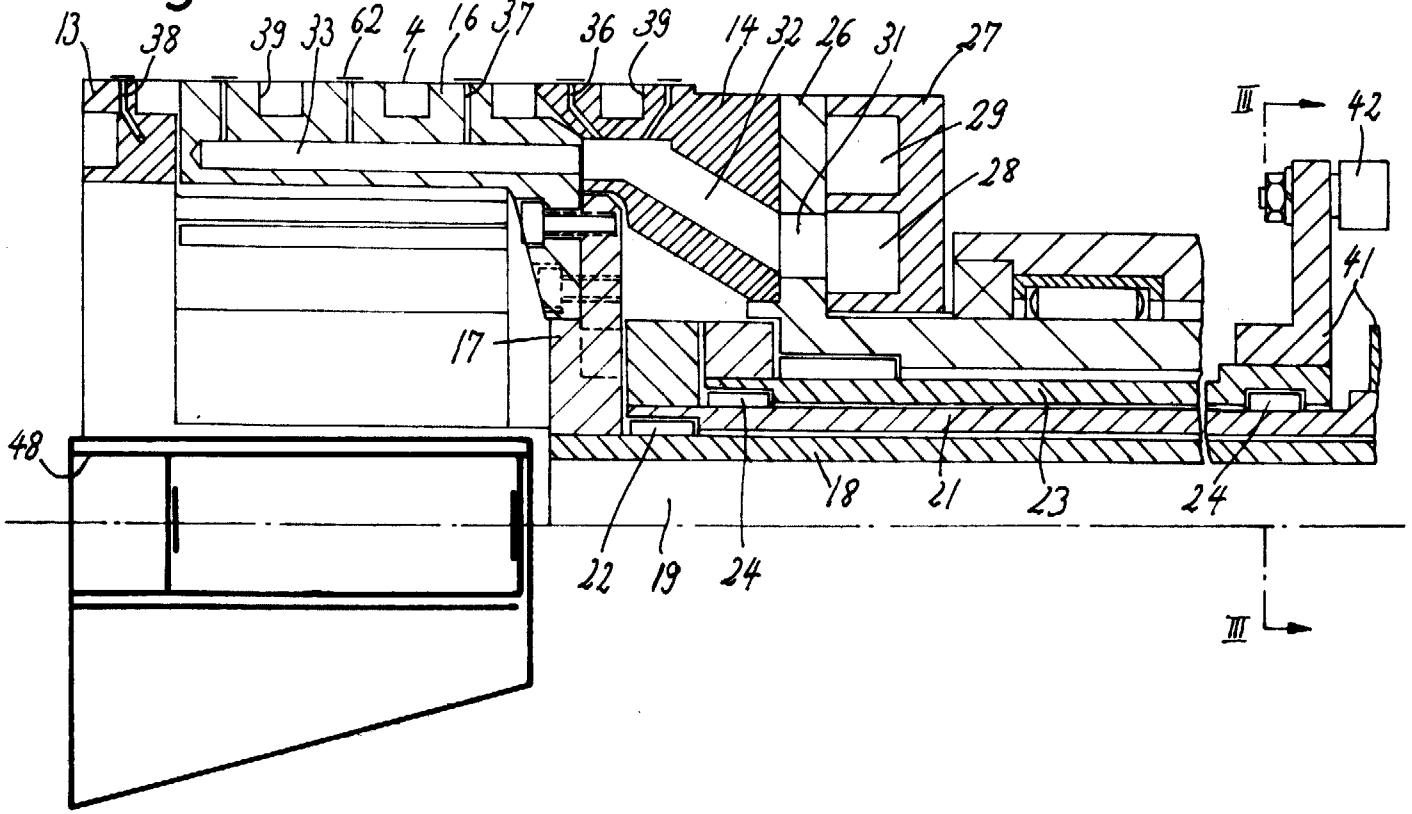
FIG. 2 is an enlarged fragmentary sectional view as seen in the direction of arrows from the line II—II of FIG. 1.
Figure 3:
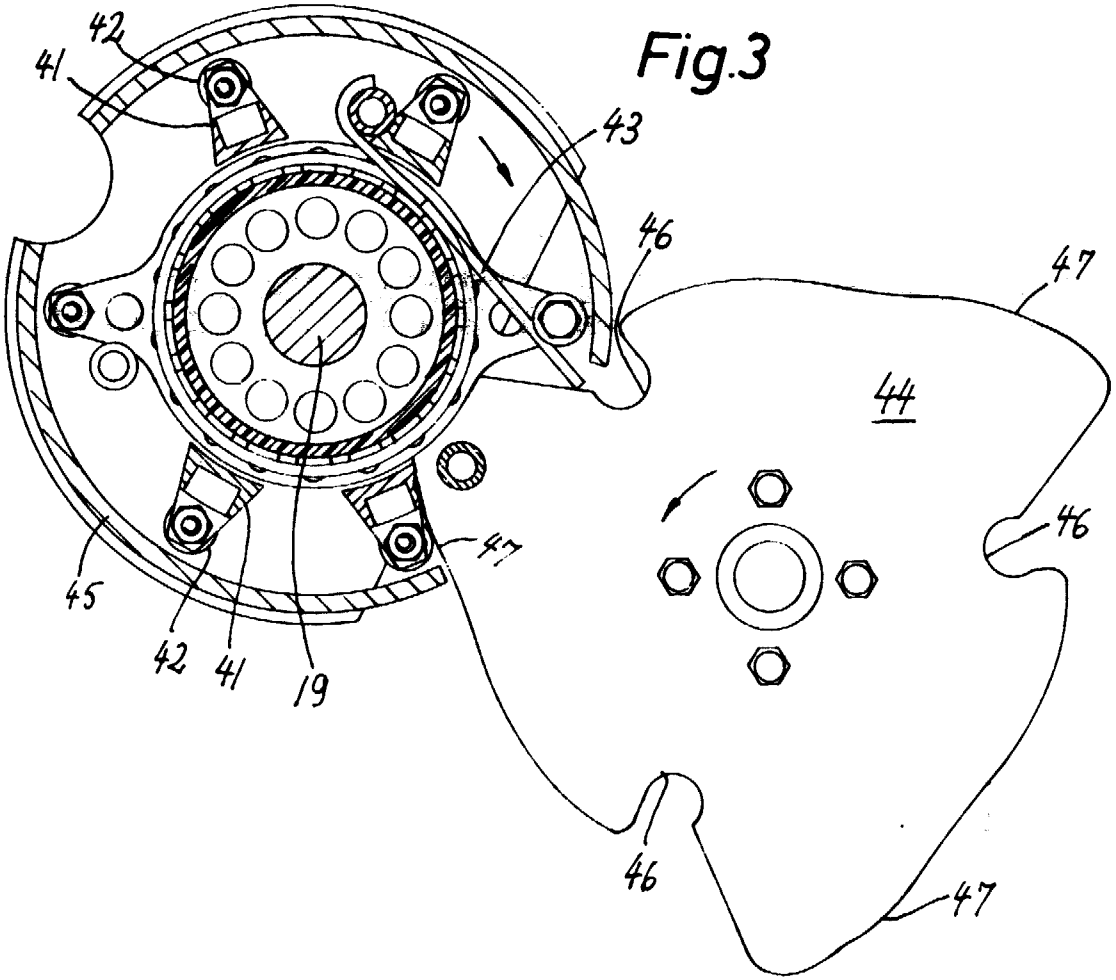
FIG. 3 is a view as seen in the direction of arrows from the line III—III of FIG. 2.

The drum 7 is hollow and its cylindrical barrel or shell 7A is formed with six equally spaced openings or slots 11 which alternate with webs or lands 12 extending lengthwise of the drum between two end walls or flanges 13, 14 shown in FIG. 2. The openings 11 accommodate portions of label carriers 16 which are installed in the interior of the drum 7 and are pivotable relative to the drum 7 between first and second end positions in which each carrier is respectively adjacent to the next-following and the preceding web 12 (as considered in the direction of rotation of the drum 7). In FIG. 1, the drum 7 rotates clockwise in stepwise fashion. Two neighboring carriers 16 constitute a pair or group of carriers, i.e., the illustrated drum 7 contains three pairs or groups of carriers. The carriers 16 of each group are movable relative to the carriers 16 of each other group. The means for moving the three groups of carriers 16 relative to each other and with respect to the drum 7 is illustrated in FIGS. 2 and 3. As shown in FIG. 2 for a carrier 16 of one of the three groups, each carrier of a first group has a suitably configurated arm 17 which is connected to a motion transmitting sleeve 18 surrounding a shaft 19 on which the drum 7 rotates. Each carrier 16 of another group has two somewhat different arms 17 which connect it to a second motion transmitting sleeve 21 surrounding the sleeve 18. The sleeve 21 rotates on one or more bearings 22 which surround the sleeve 18. The arms 17 of the third set of carriers 16 are connected to a motion transmitting sleeve 23 which rotates on one or more bearings 24 surrounding the sleeve 21. The arms 17 of each group of carriers 16 are configured in such a way that they cannot prevent rotation of the sleeves 18, 21 and 23 with respect to each other. The six carriers 16 are disposed one behind the other, as considered in the circumferential direction of the drum 7.

The drum 7 is rotatable on the shaft 19 together with a valve plate 26 which is adjacent to the outer end face of its flange 14. The indexing means for intermittently rotating the drum 7 is not shown in the drawing; such indexing means preferably receives motion from the main prime mover of the aforementioned packing machine. The valve plate 26 is disposed between the flange 14 and a stationary manifold 27 having two suction chambers 28, 29 which are connected to the intake of a suitable suction generating device, e.g., a vacuum pump (not shown). The suction generating device may be one of the suction generating devices which are used in the packing machine whose take-off conveyor delivers packs 3 to the transporting system 1 (or whose take-off conveyor constitutes the conveyor 2 of FIG. 1). The valve plate 26 has a groove 31 which communicates, in certain angular positions of the valve plate, with the suction chamber 28 of the manifold 27. The groove 31 further communicates with a channel 32 in the flange 14 of the drum 7, and the channel 32, in turn, communicates with channels or blind bores 33 machined into the carriers 16.

The valve plate 26 has a second groove (not shown) which, in certain angular positions of the drum 7, communicates with the suction chamber 29 of the manifold 27 as well as with channels 34 (shown in FIG. 1) which are machined into the webs 12 of the barrel 7A. The channel 32 communicates with suction ports 36 which extend to the peripheral surface of the flange 14, and the blind bores 33 communicate with label retaining suction ports 37 which extend to the outer end faces of the respective carriers 16. The channels 34 communicate with suction ports 38 which are machined into and extend to the peripheral surface of the flange 13.

The peripheral surface of the barrel 7A is provided with several circumferentially extending grooves 39 some of which register with similar grooves in the outer end faces of the carriers 16. These grooves serve for temporary reception of arms or prongs which deliver successive lowermost labels 4 from the magazine 6. Such prongs are disclosed in the aforementioned copending application Ser. No. 636,580 of Schubert.

The means for rotating the sleeves 18, 21 and 23 relative to each other is shown in FIGS. 2 and 3. Each sleeve is rigidly connected with two levers 41 which are provided with roller followers 42 cooperating with a cam 44. FIG. 2 merely shows a single lever 41 (in its entirety) which is connected to or made integral with the sleeve 23. The levers 41 which are connected with the sleeves 21 and 18 are located to the right of the fully illustrated lever 41. Thus, the total number of levers 41 is six, and two neighboring levers 41 are connected to each other by a leaf spring 43 (one shown in FIG. 3). The purpose of the springs 43 is to maintain the respective carriers 16 in one of their end positions during certain stages of each revolution of the drum 7, namely, in abutment with the neighboring (next-following) webs 12 of the barrel 7A. Thus, when the carriers 16 are free to follow the bias of the respective springs 43, they rotate the drum 7 in predetermined positions with respect to the barrel 7A. The cam 44 has three equally spaced peripheral recesses or notches 46 which alternate with suitably configurated cam faces 47. The recesses 46 can receive the oncoming roller followers 42. When a roller follower 42 enters a recess 46, the cam 44 causes the corresponding carrier or carriers 16 to move relative to the barrel 7A, namely, in a direction from abutment with the web 12 which is located therebehind (as considered in the direction of rotation of the drum 7) and toward a position of abutment with the preceding web 12. Such movement results in stressing of the corresponding leaf spring 43. The purpose of the cam faces 47 is to maintain the respective carriers 16 in abutment with the preceding webs 12 during certain stages of each revolution of the drum 7. The levers 41, the roller followers 42 and the springs 43 are confined in a cylindrical housing 45 shown in FIG. 3, and the housing 45 has an opening for a portion of the cam 44.

As mentioned above, the drum 7 is hollow; its interior accommodates a hollow prismatic folding device 48 which is reciprocable in directions indicated by a double-headed arrow 48A. The folding device 48 is surrounded by the path of orbital movement of carriers 16 about the axis of the shaft 19. This folding device extends diametrically of the drum 7 and its internal space is dimensioned in such a way that a pack 3 can pass therethrough on its way from the discharge end of the path which is defined by the transporting system 1 into a pocket 49 of the conveyor 9. The means for moving the folding device 48 back and forth is not specifically shown in the drawing, such reciprocating means may comprise a rack and pinion drive or the like. The orientation of the folding device 48 remains unchanged, i.e., this device cannot be rotated in or counter to the direction of rotation of the drum 7. The inlet of the folding device 48 is shown at 48B, and its outlet is shown at 48D.

The shaft 19 for the drum 7 is assumed to be horizontal. The axis of rotation of the drying conveyor 9 is located at a level which is different from the level of the axis of the shaft 19. In the embodiment of FIG. 1, the axis of the conveyor 9 is located at a level below the axis of the shaft 19. The conveyor 9 is rotated in stepwise fashion and in a counterclockwise direction, as viewed in FIG. 1.

The paster 8 comprises a tank 51 which receives fresh adhesive via supply conduit 52 and further communicates with a return conduit 53. A withdrawing roller 54 which dips into the supply of adhesive paste in the tank 51 transfers a film of adhesive onto the peripheral projection or lobe 58 of a rotary drum-shaped applicator 57. The lobe 58 consists of a row of discrete sections disposed one behind the other, as viewed in FIG. 1, to apply patches 62 of adhesive to longitudinally spaced portions of the exposed side of a label 4 which is attracted to the adjacent carrier 16 and to the adjacent portions of peripheral surfaces of the flanges 13 and 14 (see FIG. 2). The reference character 56 denotes a blade which removes the surplus of adhesive from the periphery of the withdrawing roller 54.

The transporting system 1 further comprises a mobile platform or lifter 59 which defines the discharge end of the path for successive cigarette packs 3 and is movable between the solid-line and phantom-line positions of FIG. 1. When moved to the raised position (e.g., by a fluid-operated double-acting cylinder and piston unit whose piston rod is shown at 63), the platform 59 places the foremost pack 3 into register with the inlet 48B of the folding device 48 and into the path of movement of a pack-advancing pusher 61 which is actuatable by a double-acting fluid-operated cylinder and piston unit (having a piston rod 64) to perform a working and a return stroke during each interval of dwell of the drum 7. The pusher 61 performs several functions including causing the adhesive-coated side of a label 4 which extends transversely across the inlet 48B of the folding device 48 to adhere to the front end face 3A of the oncoming pack 3'', to push the thus applied label 4 against the rear end face 3E of the preceding pack 3' (in the folding device 48), and to transfer the preceding pack 3' from the interior of the device 48 into the registering pocket 49 of the conveyor 9.

The drum 7, the platform 59, the pusher 61 and the conveyor 9 are moved intermittently. The synchronizing means may be of any conventional type, e.g., of the type disclosed in the aforementioned U.S. Pat. No. 4,004,395 to Bardenhagen et al. The withdrawing device for labels 4 also operates intermittently, i.e., it withdraws successive lowermost labels 4 from the opening at the lower end of the magazine 6 at intervals which coincide with the arrival of successive carriers 16 at the label receiving station, i.e., at the eleven o'clock position, as viewed in FIG. 1. The lobe 58 of the applicator 57 applies patches 62 of adhesive to successive labels 4 which already adhere to the adjacent carriers 16 and to the adjacent portions of peripheral surfaces of the flanges 13, 14.

The moving parts of the paster 8, the cam 44 and the conveyor 2 of the transporting system 1 are operated continuously.

The operation is as follows:

FIG. 1 shows that a label-bearing pack 3' is located in the interior of the folding device 48. When the apparatus is started, i.e., when the interior of the folding device 48 does not contain a pack 3' while the pusher 61 advances a pack 3'' from the raised platform 59 toward and into the inlet 48B, the foremost pack is discarded or opened for recovery of its contents because reliable and predictable application of labels 4 to successive packs is predicated upon the presence of a pack in the folding device 48 at the time when the pusher 61 performs a forward stroke. Of course, the application of a label to the foremost pack may be entirely satisfactory; nevertheless, such pack is preferably segregated in order to avoid the remotest possibility of introducing an improperly labelled pack into a carton or another receptacle which is shipped to wholesalers or retailers. The foremost pack can be segregated by hand or automatically in a manner not forming part of the invention.

The label 4 which was withdrawn from the magazine 6 adheres to the adjacent carrier 16 and flanges 13, 14 (see the suction ports 36, 37 and 38 in FIG. 2). The drum 7 is thereupon indexed clockwise, as viewed in FIG. 1, and such movement is shared by the carriers 16. During indexing, the freshly withdrawn label 4 is provided with patches 62 of adhesive by the continuously rotating applicator 57 of the paster 8. Next indexing of the drum 7 results in the transfer of adhesive-coated label 4 in front of the inlet 48B (the patches 62 are applied to the outer side of the label 4, i.e., the adhesive does not contact the drum 7 and/or the carriers 16). Before the adhesive-coated label 4 reaches the inlet 48B, the roller follower 42 for the carrier 16 which is inwardly adjacent to such label enters the oncoming recess 46 of the cam 44 which latter rotates at one third the speed of the drum 7. This results in disconnection of ports 37 of such carrier 16 from the channel 32 (i.e., the carrier ceases to attract the intermediate portion of the label 4) and in movement of the carrier toward the preceding web 12, i.e., the corresponding spring 43 is caused to store energy. The carrier 16 is arrested by the preceding web 12 and, as shown in FIG. 1, then assumes a position at the underside of the inlet 48B of the folding device 48. The label 4 which is located in front of the inlet 48B is then attracted solely by the suction ports 36, 38 of the flanges 14 and 13.

The platform 59 lifts the foremost pack 3'' off the conveyor 2 not latter than when the adhesive-coated label 4 overlies the inlet 48B. As shown in FIG. 1, the apparatus comprises a stop 66 which is located to the left of the platform 59 and arrests the foremost pack 3 on the conveyor 2. The oncoming packs pile up behind the arrested pack and form an orderly row which advances by a step (because the conveyor 2 is driven without interruptions) as soon as the platform 59 reassumes its lower position. The platform 59 engages the marginal portions of the pack 3 which abuts against the stop 66 so that it can bypass the upper reach of the conveyor 2 during movement between raised and lower positions.

During the period of dwell which follows the indexing of the drum 7 to that position in which the foremost adhesive-coated label overlies the inlet 48B, the pusher 61 performs a working stroke and advances the pack 3'' from the platform 59 into the interior of the folding device 48. In the course of such movement, the front end face 3A of the pack 3'' contacts the patches 62 of adhesive on the exposed side of the central portion of the label 4 and simultaneously pushes the left-hand side of the central portion of such label against the rear end face 3E of the preceding pack 3'. This insures that the label 4 immediately adheres to the front end face 3A of the pack 3'' with a force which suffices to overcome suction in the ports 36, 38 of the flanges 14, 13, i.e., the uncoated sides of the two end portions of the label are automatically stripped off the flanges 13, 14 and begin to overlie the adjacent portions of lateral surfaces 3B, 3D of the pack 3'' as soon as the front end face 3A of such pack advances into and beyond the inlet 48B of the folding device 48. The maintenance of suction in the ports 36, 38 of the flanges 14, 13 to the last moment, i.e., until the outermost ends of the label 4 adhere to the respective lateral surfaces 3B, 3D of the pack 3'', is desirable and advantageous because it contributes to predictable application of the label and reduces the likelihood of the formation of creases in such end portions of the label.

As the pack 3" advances into and through the interior of the folding device 48, the two lateral walls of the device 48 fold the end portions of the label 4 over the lateral surfaces 3B, 3D. At the same time, the pack 3" pushes the pack 3' toward the drying conveyor 9. The working or forward stroke of the pusher 61 is sufficiently long to insure that the pack 3' is expelled from the folding device 48 and enters the adjacent empty pocket 49 of the conveyor 9 which is then at a standstill, i.e., it dwells during the interval between two successive indexing movements in a counterclockwise direction, as viewed in FIG. 1. Since the central portion of a label 4 which has been applied to the pack 3" bears against the rear end face 3E of the pack 3' while the pack 3" advances into and in the interior of the folding device 48, the formation of creases in such central portion of the label is highly unlikely and, in fact, impossible as long as all parts of the apparatus operate properly.

The pusher 61 is retracted to the position of FIG. 1 as soon as it completes the forward stroke and thus insures that the drum 7 can be indexed again in order to place the next adhesive-coated label 4 in front of the inlet 48B.

Indexing of the drum 7 takes place simultaneously with indexing of the turret 9 whereby the rear end face 3E of the pack 3' (now in the pocket 49 of the turret 9) automatically moves away from the freshly applied label on the front end face 3A of the pack 3" (now the folding device 48). Since the indexing movements of the drum 7 and turret 9 are synchronized, the rear end portion of the pack 3' in the pocket 49 automatically leaves the adjacent opening 11 while the drum 7 and the turret 9 respectively rotate clockwise and counterclockwise, as viewed in FIG. 1. Thus, the packs in the pockets of the turret 9 cannot interfere with indexing of the drum 7. The conveyor 9 can be indexed while folding device 48 is held in the position of FIG. 1 because its axis is located at a level below the axis of the drum 7, i.e., while the conveyor 9 rotates counterclockwise, as viewed in FIG. 1, the rear end face 3E of the freshly introduced labelled pack 3 moves above as well as away from the label 4 on the pack in the folding device 48. Thus, the rear end face 3E cannot rub against the freshly applied label. This prevents any shifting or deformation of the label in the folding device 48.

In order to prevent the carrier 16 in the opening 11 which is nearest to the conveyor 9 from interfering with the transfer of a pack into the adjacent pocket 49 and/or with indexing of the conveyor 9, such carrier remains adjacent to the preceding web 12 and is caused to move backwards against the next-following web 12 during renewed indexing of the drum 7 or after the corresponding opening 11 is empty as a result of indexing of the turret 9 and ensuing retraction of the freshly transferred pack from the aforementioned opening 11. FIG. 1 shows that such carrier 16 returns to its rear end position not later than when the respective opening 11 is located below the magazine 6. The just described retention of the carrier 16 in a position of abutment with the preceding web 12 is insured by one of the cam faces 47. The corresponding spring 43 is thereupon free to dissipate energy and to move the carrier 16 against the next-following web 12.

When the apparatus is to apply labels to a different type of packs (e.g., to shorter packs), the folding device 48 is replaced with a shorter folding device. Furthermore, the cylinder and piston unit including the piston rod 64 is adjusted to change the stroke of the pusher 61. Also, the shorter folding device is moved nearer to the discharge end of the path which is defined by the transporting system 1 to insure that the label whose central portion adheres to a pack in front of the advancing pusher 61 will reach the trailing end face of the pack in the folding device as soon as such central portion of the label adheres to the oncoming pack. The folding device thereupon shares the last stage of movement of the pusher 61 to the extended position so as to insure that the short pack which is confined therein will be expelled all the way into the registering pocket of the drying turret.

An important advantage of the improved labelling apparatus is that the path portion along which the labels 4 are transported from the magazine 6 or a similar source to a position in front of and transversely across the inlet 48B of the passage in the folding device 48 is short as well as that one and the same part (the barrel 7A) supports the labels during travel from the magazine and all the way to the inlet. Moreover, the application of labels to the end faces 3A and lateral surfaces 3B, 3D of oncoming packs 3" takes place without any lateral shifting of the labels so that each label is applied in the same way as the preceding labels. Furthermore, the labels 4 are not likely to move lengthwise during folding of their end portions over the respective lateral surfaces 3B and 3D because the central portions of such labels are then pinched between the front end faces 3A of the packs 3" and the rear end faces 3E of the preceding packs 3'. This, in addition to the fact that the adhesive-coated sides of the central portions of labels 4 adhere to the front end faces 3A of the oncoming packs 3", invariably insures that the folding of end portions by the corresponding walls of the folding device 48 takes place without any undesirable changes of orientation of labels. Also, such mode of applying the labels insures that the central portions as well as the end portions of the labels are free of creases which would affect the appearance of the packs.

The inner diameter of the rotary member 7 is preferably selected in such a way that the barrel 7A can readily accommodate a folding device 48 having a channel or passage whose length matches the length of longest packs which are to be labelled in the improved apparatus. If the apparatus is to be converted for the labelling of shorter packs, the folding device 48 is replaced with a shorter folding device and the aforementioned means for moving the shorter folding device in directions indicated by arrow 48B is activated in synchronism with actuation of the pusher 61 to insure that the front end face of each oncoming shorter pack abuts against the rear end face of the pack in the passage of the shorter folding device as well as that the shorter folding device can move sufficiently close to the opening 11 at the nine o'clock position of the rotary member 7 (as viewed in FIG. 1) to guarantee the transfer of the preceding pack into the adjacent pocket 49 of the turrent 9 to the extend which is necessary to allow for unimpeded indexing of the turret simultaneously with indexing of the rotary member 7.

The grouping of label carriers 16 into pairs is desirable and advantageous in order to reduce the number of parts which are used to move the carriers relative to the barrel 7A. In the row of carriers 16 in successive openings 11 of the barrel 7A (as considered in the circumferential direction of the rotary member 7), a carrier 16 belonging to one pair of carriers is located between the carriers which belong to other pairs of carriers.

The placing of the paster 8 between the magazine 6 and the discharge end of the path which is defined by the transporting system 1 is advantageous because the labels 4 which are attracted to the carriers 16 can be provided with patches 62 of adhesive while the carriers rotate with the member 7. Furthermore, such arrangement renders it possible to utilize a paster wherein the moving parts need not be operated in stepwise fashion.

With minor modifications, the apparatus can be used to apply labels transversely across the front end faces of soft packs or the like.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the claims.

What is claimed is:

1. Apparatus for applying adhesive labels having a predetermined length to the front end faces and adjacent lateral surfaces of substantially prismatic items, especially packs for cigarettes or the like wherein the width of the front end faces between the lateral surfaces is less than said predetermined length, comprising means for transporting a series of items along a first path having a discharge end; a source of labels; means for transferring labels from said source, including a hollow rotary member and a plurality of label carriers mounted in and rotatable with said member along an endless second path extending along said source and said discharge end, each of said carriers being movable relative to said member between first and second positions in which the carrier is respectively ready to accept a label from said source and is remote from such label; a folding device in said member, said device defining a passage for successive items of said series and having an inlet adjacent said discharge end inwardly of said second path and an outlet, said carriers having means for retaining labels during transfer of labels from sid source to that portion of said second path which is located in front of said inlet and said transferring means further comprising means for moving said carriers to said first positions ahead of said source and to said second positions not later than in said portion of said second path so that each carrier moves away from the respective label while the label extends transversely of and beyond said inlet; and means for advancing successive items of said series from said discharge end into and through said passage whereby the front end face of each oncoming item entrains and is bonded to the label which extends across said inlet and pushes such label against the preceding item while said device folds the end portions of the label over the adjacent lateral surfaces of the respective oncoming item.

2. Apparatus as defined in claim 1, wherein said folding device is movable in the interior of said member in and counter to the direction of movement of said advancing means.

3. Apparatus as defined in claim 1, wherein said carriers are movable back and forth, as considered in the circumferential direction of said member.

4. Apparatus as defined in claim 1, wherein said carriers are disposed in pairs and the carriers of each pair are located substantially diametrically opposite each other with respect to the axis of said member, said moving means including means for moving each pair of carriers independently of each other pair of carriers.

5. Apparatus as defined in claim 4, wherein said carriers form a row of aligned carriers, as considered in the circumferential direction of said member, and the neighboring carriers of said row belong to different groups of carriers.

6. Apparatus as defined in claim 1, wherein said member includes a substantially cylindrical barrel having openings for said carriers.

7. Apparatus as defined in claim 1, wherein said retaining means includes suction ports in said carriers.

8. Apparatus as defined in claim 7, wherein said member includes portions flanking said carriers and having suction ports for attracting the end portions of labels, at least during transport of such labels in front of said inlet.

9. Apparatus as defined in claim 1, wherein said moving means comprises a rotary cam.

10. Apparatus as defined in claim 1, wherein said first path includes a portion which is located at a first level and said discharge end is located at a second level, said transporting means including means for moving successive foremost items of said series from said first level to said second level in front of said advancing means.

11. Apparatus as defined in claim 10, wherein said advancing means comprises a reciprocable pusher.

12. Apparatus as defined in claim 11, further comprising means for actuating said advancing means and said last mentioned moving means and for rotating said member at predetermined intervals.

13. Apparatus as defined in claim 1, further comprising means for applying adhesive to successive labels while such labels are held by the retaining means of the respective carriers and said member rotates.

14. Apparatus as defined in claim 1, further comprising a conveyor having pockets for reception of items which are expelled from said folding device via said outlet during advancement of items into said folding device via said inlet.

15. Apparatus as defined in claim 14, wherein said conveyor is an indexible turret and said member is indexible in synchronism with said turret.

16. Apparatus as defined in claim 15, wherein the axes of said turret and said rotary member are disposed at different levels.

* * * * *